US010096424B2

(12) United States Patent
Miyauchi et al.

(10) Patent No.: US 10,096,424 B2
(45) Date of Patent: Oct. 9, 2018

(54) METHOD OF MANUFACTURING REACTOR

(71) Applicants: Hiroyuki Miyauchi, Toyota (JP); Shuichi Hirata, Nisshin (JP); Takeshi Okada, Kariya (JP); Satoshi Ito, Kariya (JP); Kengo Hara, Nagoya (JP)

(72) Inventors: Hiroyuki Miyauchi, Toyota (JP); Shuichi Hirata, Nisshin (JP); Takeshi Okada, Kariya (JP); Satoshi Ito, Kariya (JP); Kengo Hara, Nagoya (JP)

(73) Assignees: TOYOTA JIDOSHA KABUSHIKI KAISHA, Aichi-ken (JP); TOKAI KOGYO CO., LTD., Aichi-ken (JP)

( * ) Notice: Subject to any disclaimer, the term of this patent is extended or adjusted under 35 U.S.C. 154(b) by 311 days.

(21) Appl. No.: 14/976,579

(22) Filed: Dec. 21, 2015

(65) Prior Publication Data

US 2016/0189862 A1 Jun. 30, 2016

(30) Foreign Application Priority Data

Dec. 25, 2014 (JP) ..... 2014-262735

(51) Int. Cl.
*H01F 41/00* (2006.01)
*H01F 27/02* (2006.01)
(Continued)

(52) U.S. Cl.
CPC ..... *H01F 41/005* (2013.01); *H01F 27/022* (2013.01); *H01F 27/306* (2013.01); *H01F 27/324* (2013.01); *H01F 37/00* (2013.01)

(58) Field of Classification Search
CPC . H01F 5/02; H01F 5/04; H01F 27/022; H01F 27/027; H01F 27/2852;
(Continued)

(56) References Cited

U.S. PATENT DOCUMENTS 7,221,252 B1 * 5/2007 Chang ..... H01F 27/306 336/212
8,334,745 B2 * 12/2012 Chen ..... H01F 38/10 336/170
(Continued)

FOREIGN PATENT DOCUMENTS

CN 103971902 A 8/2014
JP 2009054937 A * 3/2009
(Continued)

*Primary Examiner* — Carl Arbes
(74) *Attorney, Agent, or Firm* — Sughrue Mion, PLLC

(57) ABSTRACT

Breakage of a ring core or a bobbin upon injection molding of molten resin is to be prevented in a method of manufacturing a reactor including the ring core. A reactor includes a ring core, a bobbin, a pair of coils, and a plastic cover. The bobbin includes a pair of cylinder portions, and flanges connecting ends of the cylinder portions. The reactor is manufactured by following processes. First protrusions that make contact with an inner circumferential surface of the ring core are provided on outer sides of the flanges along a cylinder axis direction. Second protrusions are provided at positions facing the corresponding first protrusions across the ring core are provided on a cavity surface of a mold that forms the plastic cover by injection molding. The plastic cover is formed by injecting molten resin into the mold while clamping the ring core by the first and second protrusions.

2 Claims, 4 Drawing Sheets

(51) Int. Cl.
*H01F 27/30* (2006.01)
*H01F 27/32* (2006.01)
*H01F 37/00* (2006.01)

(58) Field of Classification Search
CPC ..... H01F 27/29; H01F 27/292; H01F 27/306; H01F 37/00; H01F 41/005; H01F 27/32
See application file for complete search history.

(56) References Cited

U.S. PATENT DOCUMENTS

| | | | | |
|---|---|---|---|---|
| 8,598,973 | B2 * | 12/2013 | Kawaguchi | H01F 3/14 336/199 |
| 8,994,487 | B2 * | 3/2015 | Lin | H01F 27/292 336/182 |
| 9,343,212 | B2 * | 5/2016 | Shinohara | H01F 27/022 |
| 2012/0044033 | A1 | 2/2012 | Kawaguchi | |
| 2013/0135072 | A1 * | 5/2013 | Inaba | H01F 27/022 336/90 |
| 2014/0218156 | A1 * | 8/2014 | Shinohara | H01F 27/022 336/192 |
| 2014/0218158 | A1 * | 8/2014 | Miyamoto | H01F 27/306 336/198 |

FOREIGN PATENT DOCUMENTS

| | | | | |
|---|---|---|---|---|
| JP | 2010-118611 | A | | 5/2010 |
| JP | 2010118611 | A | * | 5/2010 |
| JP | 2010-263074 | A | | 11/2010 |
| JP | 2014-150220 | A | | 8/2014 |

* cited by examiner

METHOD OF MANUFACTURING REACTOR

CROSS-REFERENCE TO RELATED APPLICATION

This application claims priority to Japanese Patent Application No. 2014-262735 filed on Dec. 25, 2014, the contents of which are hereby incorporated by reference into the present application.

TECHNICAL FIELD

The present invention relates to a method of manufacturing a reactor in which a ring core and a bobbin are covered by a plastic cover.

DESCRIPTION OF RELATED ART

A reactor in which a ring core, a bobbin, and a coil are covered by a plastic cover is known. Japanese Patent Application Publication No. 2010-118611 discloses an example of such a reactor. The ring core includes a pair of straight portions. Each of the pair of cylinder portions provided on the bobbin cover the corresponding straight portion of the ring core. The pair of cylinder portions are connected to each other by their ends. A coil is disposed on each cylinder portion. The plastic cover is formed by pouring molten resin into a mold in which a subassembly of the ring core, the bobbin, and the coil is contained. According to Japanese Patent Application Publication No. 2010-118611, the resin is poured into the mold while pressing the ring core from its both sides within the mold. Hereinbelow, the cylinder portions of the bobbin may simply be termed bobbin cylinder portions

BRIEF SUMMARY OF INVENTION

In resin molding in general, injection is carried out in a closed mold by applying pressure on molten resin. In a case of a reactor including a bobbin and a ring core, in which ends of a pair of cylinder portions are connected, there is a risk that edges of openings of the bobbin cylinder portions and an inner circumferential surface of the ring core are displaced and thus make contact with each other when the ring core is pressed from both sides. When highly pressurized resin is injected in a state where the edges of the openings of the bobbin cylinder portions and the inner circumferential surface of the ring core are displaced and making contact, stress is concentrated on the edges of the openings, and a core or the bobbin may thereby break. The present description provides a suitable method of manufacturing a reactor in which a ring core and a bobbin are covered by a plastic cover. Especially, it provides a technique that prevents the edges of the openings of the bobbin and the inner circumferential surface of the ring core from being displaced and making contact, and prevents the ring core or bobbin from breaking upon injecting the molten resin.

A reactor disclosed herein comprises a ring core, a bobbin, a pair of coils, and a plastic cover. The ring core comprises a pair of straight portions extending in parallel. The bobbin includes a pair of cylinder portions and a pair of connecting portions. Each of the pair of cylinder portions has ends, and covers the corresponding straight portion of the ring core. Each of the connecting portions connects the corresponding ends. Each of the pair of coils is wound on the corresponding cylinder portion. Further, the plastic cover covers the ring core, the bobbin, and the pair of coils.

In a method of manufacturing a reactor disclosed herein, protrusions are provided on the bobbin for preventing breakage of the ring core or the bobbin upon the injection molding of the plastic cover. These protrusions are termed "first protrusions". The first protrusions are provided on each of the connecting portions of the bobbin at outer sides along a cylinder axis direction. The first protrusions are provided to be in contact with an inner circumferential surface of the ring core. Further, protrusions are also provided on a cavity surface of a mold in which a subassembly of the ring core, the bobbin, and the coils is to be contained and then the plastic cover is to be formed by resin injection. The protrusions provided on the mold are termed "second protrusions". Each of the second protrusions is provided at a position facing the corresponding first protrusion across the ring core. The method of manufacturing a reactor disclosed herein comprises forming the plastic cover by injecting molten resin into the mold while clamping the ring core by the first and second protrusions.

According to the method of manufacturing a reactor disclosed herein, the ring core is clamped by the first protrusions and the second protrusions that face each other, so the ring core is supported firmly within the mold. Further, the first protrusions at the both ends of the bobbin cylinder portions make contact with the inner circumferential surface of the ring core, and the bobbin is also supported firmly thereby. Due to this, edges of openings of the bobbin cylinder portions are prevented from being displaced and making contact with the inner circumferential surface of the ring core. As a result of this, the breakage of the ring core or the bobbin upon the injection molding of the molten resin can be prevented. Further details and improvements of the technique disclosed herein will be described below in the "Detailed Description of Invention".

DETAILED DESCRIPTION OF INVENTION

A method of manufacturing a reactor according to an embodiment will be described with reference to the drawings. A structure of the reactor will be described first, before explaining the manufacturing method thereof. The reactor of the present embodiment is used in a boosting converter that boosts a battery voltage in a driving system of an electric vehicle, for example. A traction motor for the electric vehicle can output power of several ten kilowatts, and a current flowing from the battery can be as large as several ten amperes. With such a large current flowing through the reactor, a flat rectangular wire with a small internal resistance is used as coils therefor.

Figure 1:
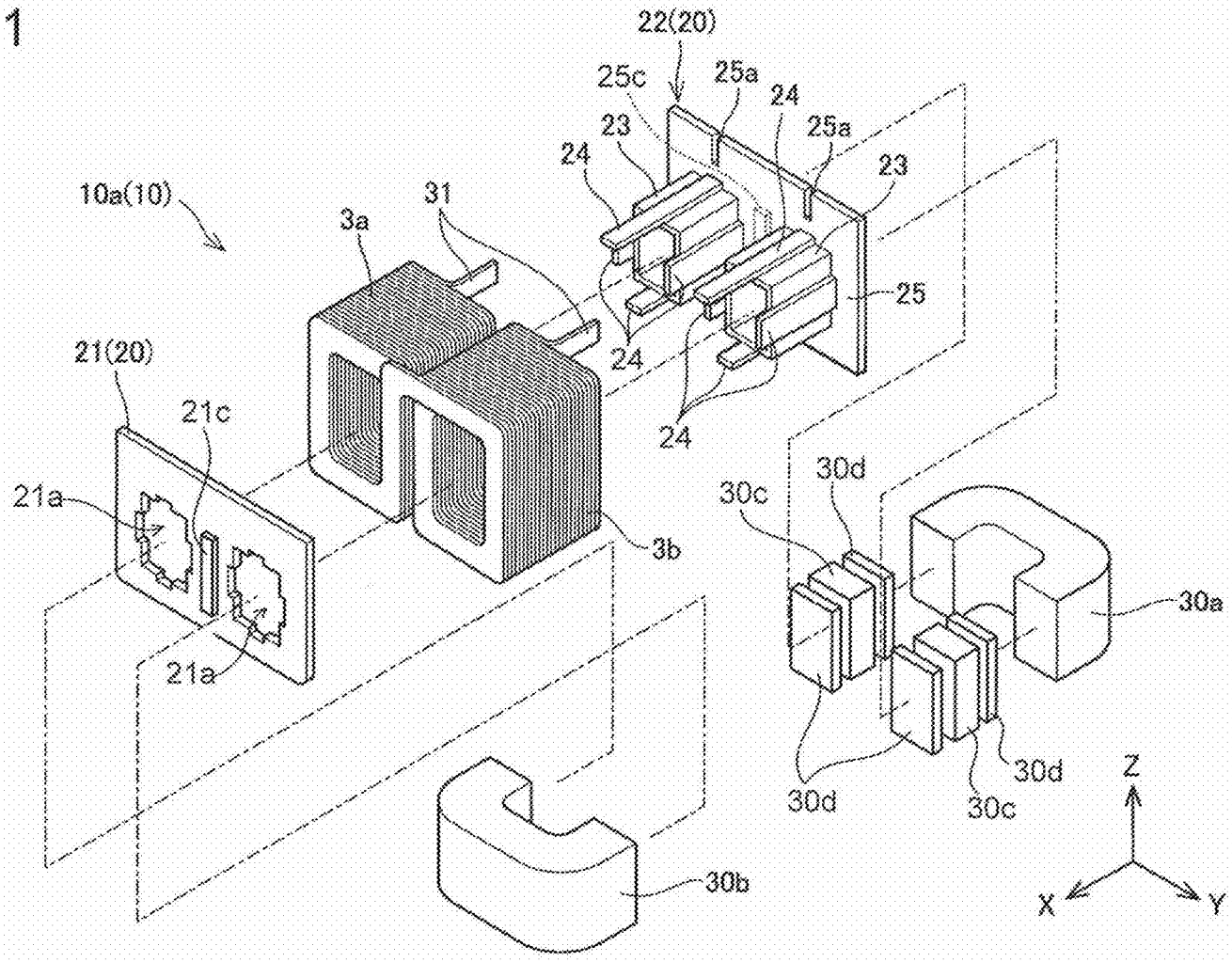
FIG. 1 is a disassembled perspective view of a reactor before a plastic cover is formed.
Figure 2:
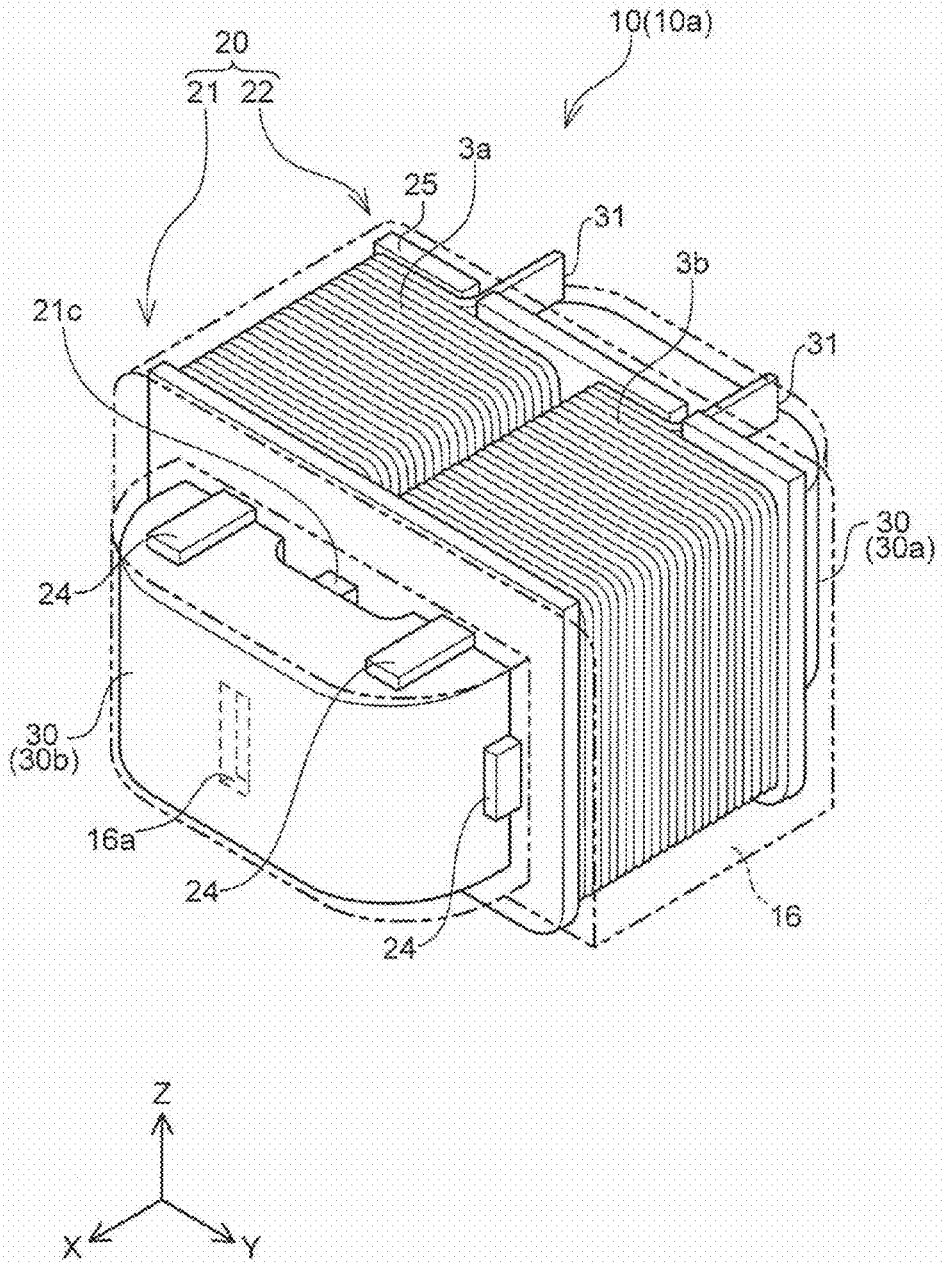
FIG. 2 is a perspective view of a subassembly of a ring core, a bobbin, and coils.
Figure 3:
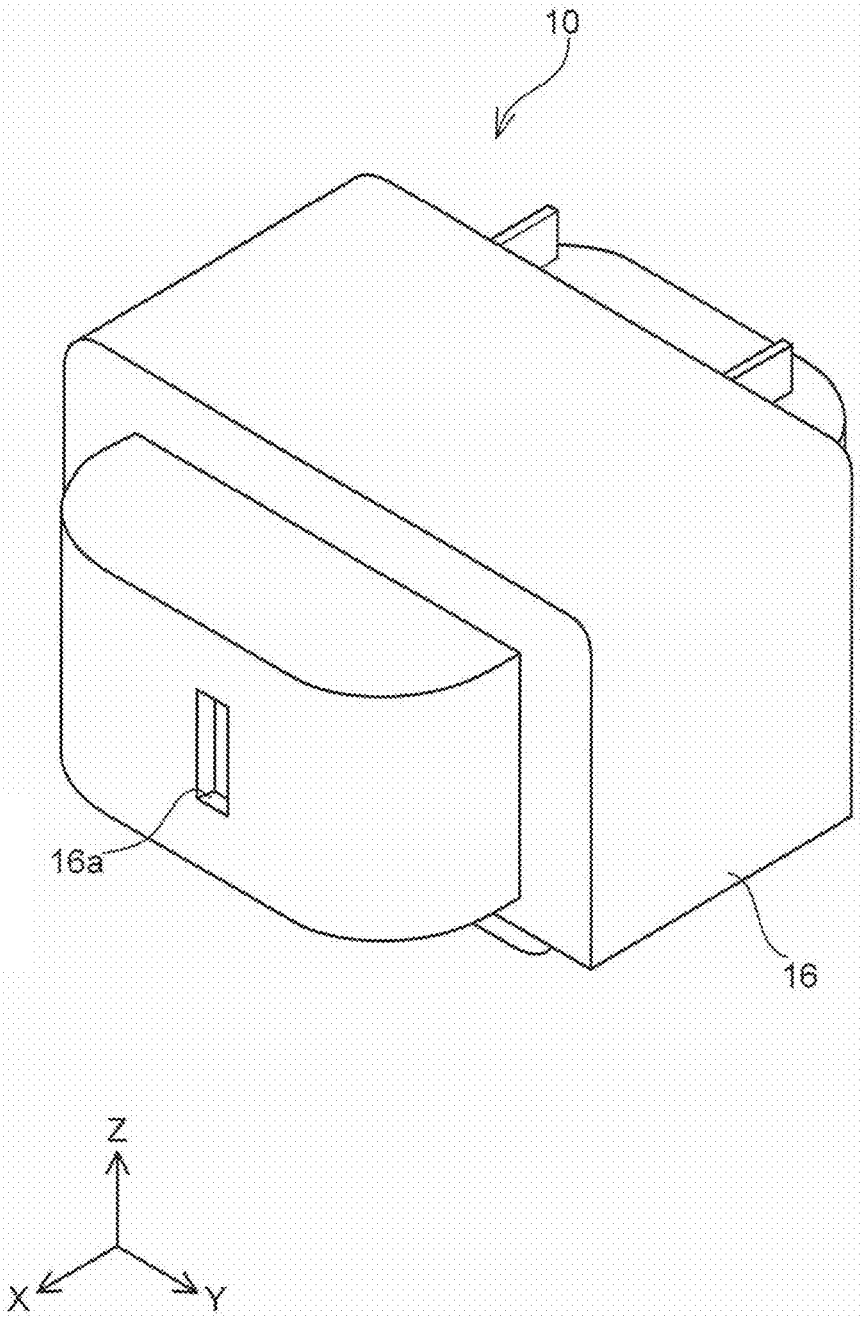
FIG. 3 is a perspective view of the reactor.

FIG. 1 is a disassembled perspective view of a reactor 10. Notably, FIG. 1 is a disassembled perspective view of the reactor before a plastic cover is attached. Hereinbelow, the reactor before a plastic cover is attached will be termed a subassembly 10*a*. FIG. 2 shows a perspective view of the subassembly 10*a*, and FIG. 3 shows a perspective view of the reactor 10. In FIG. 2, a plastic cover 16 is shown by two-dot chain lines so that the subassembly 10*a* can easily be understood. Further, hereinbelow, for the sake of convenience of the description, a positive direction along a Z-axis in a coordinate system shown in the drawings will be termed "up", a negative direction along the Z-axis will be termed "down". Further, an X-axis direction in the coordinate system shown in the drawings will be termed a cylinder axis direction.

Firstly, the reactor 10 will be described schematically using FIG. 2 and FIG. 3. As mentioned earlier, the reactor before forming the plastic cover 16 will be termed the subassembly 10*a*. The subassembly 10*a* is a device in which a resin bobbin 20 is attached to a magnetic ring core 30 (30*a*, 30*b*, 30*c*), and coils 3*a*, 3*b* in which the flat rectangular wire is wound edgewise is attached to the bobbin 20. That is, the subassembly 10*a* comprises a pair of coils 3*a*, 3*b*. The pair of coils 3*a*, 3*b* is electrically connected in serial. Hereinbelow, the pair of coils 3*a* and 3*b* will be termed a coil 3, when they are to be indicated without the need to distinguishing them. Most parts of the coil 3, the ring core 30, and the bobbin 20 are covered by the plastic cover 16. Although it will be described in detail later, the plastic cover 16 is formed by injecting molten resin in a mold in which the subassembly 10*a* is set. That is, the plastic cover 16 is formed by injection molding.

Next, a structure of the subassembly 10*a* will be described with reference to the disassembled view of FIG. 1. The ring core 30 is divided into a pair of U-shaped U core parts 30*a*, 30*b* and a pair of I-shaped block core parts 30*c*, and is configured by these parts being combined in a ring shape. In other words, the pair of U-shaped U core parts 30*a*, 30*b* and the pair of block core parts 30*c* will collectively termed the ring core 30. The pair of block core parts 30*c* is arranged in parallel in the ring core 30. A gap plate 30*d* is arranged between the U core part 30*a* (or 30*b*) and each of the block core parts 30*c*. The gap plates 30*d* may be included in the "ring core 30", or may not be included therein. The pair of block core parts 30*c* corresponds to a pair of straight portions extending in parallel in the ring core 30.

The bobbin 20 is configured of a bobbin main body 22 and a flange part 21. Both the bobbin main body 22 and the flange part 21 are made of resin. The bobbin main body 22 has a structure in which a pair of cylinder portions 23 is connected by a flange part 25 so as to be aligned in parallel. The cylinder portions 23 extend along the X-axis in the drawings. Due to this, the X-axis will be termed the cylinder axis direction. The block core parts 30*c* and the gap plates 30*d* as mentioned earlier are housed within each of the cylinder portions 23. That is, each of the pair of cylinder portions 23 covers the corresponding one of the pair of block core parts 30*c* (straight portions) of the ring core 30. The cylinder portions 23 have a rectangular cross section, and projections 24 are provided on each of such rectangular planes. The projections 24 extend along the cylinder axis direction (X-axis direction in the drawings). Further, the flange part 25 includes lead slits 25*a* for passing lead portions 31 (coil lead wires) of the coil 3 therethrough.

The flange part 21 is provided with holes 21*a* through which the cylinder portions 23 are to be passed. Further, as seen along the cylinder axis direction (X-axis direction in the drawings), a protrusion 21*c* is provided between two cylinder portions 23. The protrusion 21*c* is provided on an outer side of the flange part 21 in the cylinder axis direction. Seen along the cylinder axis direction, the protrusion 21*c* extends so as to set two cylinder portions 23 apart from each other. Further, a protrusion 25*c* is provided similarly on the flange part 25 of the bobbin main body 22 on an outer side in the cylinder axis direction. The protrusion 25*c* has an identical shape as the protrusion 21*c*. The pair of protrusions 21*c*, 25*c* is provided at both ends of the bobbin 20 by respectively being directed outwardly in the cylinder axis direction. To distinguish them from mold-side protrusions to be described later, the protrusions 21*c*, 25*c* provided on the bobbin 20 will herein be termed bobbin protrusions 21*c*, 25*c*.

Each of the pair of cylinder portions 23 fits into the corresponding one of the pair of holes 21*a* of the flange part 21. The pair of cylinder portions 23 has their ends on one side connected by the flange part 25, and ends on the other side connected by the flange part 21. The flange part 25 and the flange part 21 both correspond to connecting portions that connect the ends of the pair of cylinder portions 23. The bobbin protrusions 21*c*, 25*c* are provided on the outer sides of the respective connecting portions (flange part 25 and flange part 21) in the cylinder axis direction. The bobbin protrusions 21*c*, 25*c* are provided so as to protect the ring core 30 (U core parts 30*b*) from breakage upon injection molding the plastic cover 16, to be described later. A method of manufacturing the plastic cover 16 will be described later.

An order of assembly of the subassembly 10*a* will be described. The block core parts 30*c* are inserted to centers of insides of the cylinder portions 23 respectively. The gap plates 30*d*. are arranged on both sides of each of the block core parts 30*c*. U-shaped legs of the U core parts 30*a* are inserted into the cylinder portions 23 from a flange part 25 side of the bobbin main body 22. A gap is secured between the block core part 30*c* and the U core part 30*a* within each of the cylinder portions 23 by the gap plate 30*d*. The coils 3*a*, 3*b* in which the flat rectangular wire is wound edgewise are arranged on outer sides of the cylinder portions 23. As is clearly shown in FIG. 1, the pair of coils 3*a*, 3*b* is formed by one flat rectangular wire, and correspond electrically as one coil (coil 3). Due to high rigidity of the flat rectangular wire, a shape thereof can be sustained solely by the coil itself. After the bobbin main body 22 is inserted into the coil 3, the flange part 21 is attached onto the bobbin 20 (cylinder portions 23) from an opposite side of the coil 3. Finally, the U core parts 30*b* are inserted into the cylinder portions 23 from a flange part 21 side, and as a result, the subassembly 10*a* is completed. A gap is secured also between the U core part 30*b* and the block core part 30*c* within each of the cylinder portions 23 by the gap plate 30*d* on a U core part 30*b* side.

As shown in the perspective view of FIG. 2, in the subassembly 10*a*, four projections 24 provided on the outside of each of the cylinder portions 23 surround the four-sided plane of the end of the corresponding U-core part 30*b*, and define the position of the U core part 30*b*. Further, as shown in FIG. 2, the bobbin protrusion 21*c* provided on the outer side of the flange part 21 (outer side along the cylinder axis direction) makes contact with an inner circumferential surface of the ring core 30 (U core part 30*b*). Although not shown, the bobbin protrusion 25*c* similarly makes contact with the inner circumferential surface of the ring core 30 (U core part 30*a*) on the outer side of the flange part 25. The bobbin protrusions 21*c*, 25*c* make contact with the ring core 30 on its inner circumferential side at two positions that face each other. Due to this, relative positions of the bobbin 20 and the ring core 30 are thereby defined. Reference sign 16*a* in FIG. 2 and FIG. 3 indicates windows provided on the plastic cover 16. Details of the windows 16*a* will be described later.

The reactor 10 is completed by forming the plastic cover 16 on the subassembly 10*a*. The plastic cover 16 is formed by injection molding so as to cover substantially an entirety of the subassembly 10*a* contained in the mold, however, the plastic cover 16 is not formed underneath the subassembly 10*a*. The plastic cover 16 covers the ring core 30 and upper surfaces and side surfaces of the coils 3*a*, 3*b* wound on the bobbin 20, but does not cover lower surfaces of the coils 3*a*, 3*b*. The coil lower surfaces that are exposed from the plastic cover 16 make contact with a cooler upon when the reactor 10 is assembled in a power converter and the like. The coil lower surfaces are exposed from the plastic cover 16 so that heat from the coil 3 upon its use can efficiently be cooled by the cooler.

Figure 4:
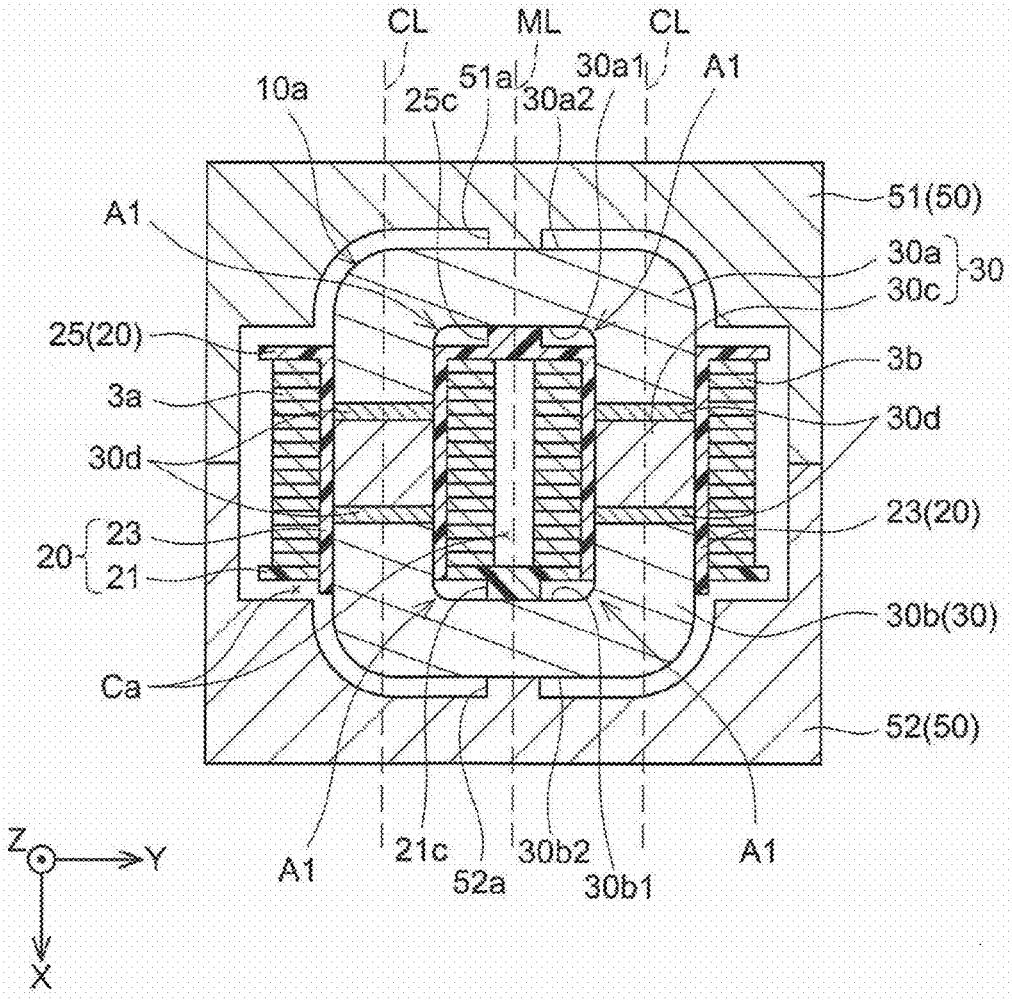
FIG. 4 is a cross sectional view of the subassembly and a mold for forming the plastic cover.

The plastic cover 16 is formed by injecting molten resin with high pressure in a cavity that is defined and formed within the mold in which the subassembly 10*a* is contained. FIG. 4 shows a cross sectional view of a mold 50 in which the subassembly 10*a* is contained. FIG. 4 is a cross sectional view that cuts the mold 50 in which the subassembly 10*a* is contained along an XY plane in the coordinate system of FIG. 2 and FIG. 3. The mold 50 is a part of an injection molding device, and a first mold 51 and a second mold 52 are respectively fixed to a movable platen and a fixed platen, however, indication of these components is omitted.

The mold 50 is configured of the first mold 51 and the second mold 52. When the subassembly 10*a* is installed and the first mold 51 and the second mold 52 are closed, a closed space (cavity Ca) is formed therein. The molten resin is injected at high pressure into the cavity Ca, and as a result of this the plastic cover 16 is formed.

As mentioned earlier, the bobbin protrusion 25*c* is provided on the outer side of the flange part 25 of the bobbin 20 (outer side in the cylinder axis direction). The bobbin protrusion 25*c* makes contact with the inner circumferential surface of the ring core 30 (U core part 30*a*). Notably, a part of the inner circumferential surface of the U core part 30*a* is flat (flat surface 30*a*1), and a flat top surface of the bobbin protrusion 25*c* makes surface contact with the flat surface 30*a*1 of the inner circumferential surface. A protrusion (mold protrusion 51*a*) is provided on a cavity surface of the first mold 51. The mold protrusion 51*a* is provided at a position that faces the bobbin protrusion 25*c* across the ring core 30 (U core part 30*a*). An outer circumferential surface (flat surface 30*a*2) of the ring core 30 (U core part 30*a*) corresponding to the flat surface 30*a*1 is also flat. A flat top surface of the mold protrusion 51*a* makes surface contact with the flat surface 30*a*2 thereof. The flat surface 30*a*1 in the inner circumferential surface and the flat surface 30*a*2 in the outer circumferential surface are parallel to each other. That is, the ring core 30 (U core part 30*a*) has the bobbin protrusion 25*c* makes surface contact with the flat surface 30*a*1 on an inner circumferential side and the mold protrusion 51*a* makes surface contact with the flat surface 30*a*2 on an outer circumferential side parallel to the flat surface 30*a*1. The ring core 30 (U core part 30*a*) is clamped by the bobbin protrusion 25*c* and the mold protrusion 51*a* from both the inner and outer circumferential sides.

The same applies to a side of the flange part 21 and the second mold 52. That is, the bobbin protrusion 21*c* is provided on the outer side of the flange part 21, and the mold protrusion 52*a* is provided on a surface of the second mold 52 (cavity surface). The mold protrusion 52*a* is provided at a position that faces the bobbin protrusion 21*c* across the ring core 30 (U core part 30*b*). A part of the inner circumferential surface of the ring core 30 (U core part 30*b*) and a part of an outer circumferential surface form flat parallel surfaces. A flat surface 30*b*1 and a flat surface 30*b*2 shown in FIG. 4 correspond to the aforementioned "flat parallel surfaces". Further, the bobbin protrusion 21*c* makes contact with the flat surface 30*b*1 on the inner circumferential side. The mold protrusion 52*a* makes contact with the flat surface 30*b*2 on the outer circumferential side. Further, the ring core 30 (U core part 30*b*) is clamped by the bobbin protrusion 21*c* and the mold protrusion 52*a* from both the inner and outer circumferential sides.

As is clearly shown in FIG. 4, the ring core 30 is pressurized from both sides on its outer circumference by the pair of mold protrusions 51*a*, 52*a*. The pair of bobbin protrusions 21*c*, 25*c* provided at both sides in the cylinder axis direction of the bobbin 20 makes contact with the inner circumferential surface of the ring core 30. The ring core 30 is firmly supported by the mold protrusions 51*a*, 52*a* and the bobbin protrusions 21*c*, 25*c*, and the bobbin 20 are supported by receiving pressure from both sides along the cylinder axis direction. Accordingly, the ring core 30 and the bobbin 20 are supported firmly within the mold.

Especially, the pair of bobbin protrusions 21*c*, 25*c* is positioned at the center between the pair of cylinder portions 23 as seen along the cylinder axis direction, and press the ring core 30 from the inside toward the outside at the miter sides along the cylinder axis direction than the cylinder portions 23. Due to this positional relationship, the inner circumferential surface of the ring core 30 is prevented from being displaced and making contact with edges of openings of the cylinder portions 23.

The molten resin is injected into the cavity Ca while the U core parts 30*a*, 30*b* positioned on the outer sides of the bobbin 20 in the cylinder axis direction are in a state of being clamped respectively by the bobbin protrusions 21*c*, 25*c* and the mold protrusions 51*a*, 52*a*. The U core parts 30*a*, 30*b*, being parts of the ring core 30 are clamped by the bobbin protrusions 21*c*, 25*c* and the mold protrusions 51*a*, 52*a*, and are firmly retained thereby. The bobbin 20 is also retained within the ring core 30. Due to this, the ring core 30 and the bobbin 20 are prevented from making contact with displacement each other while the highly pressurized molten resin is being injected. For example, if the bobbin protrusions 21*c*, 25*c* were not provided, there is a risk that inner circumferential curved portions of the ring core 30 indicated by arrows A1 in the drawings may make contact with the edges of the openings of the cylinder portions 23 of the bobbin 20. If the highly pressurized molten resin is injected in a state where the inner circumferential curved portions A1 and the edges of the openings of the cylinder portions 23 make contact, stress may be concentrated at the contacting portion, as a result of which the ring core 30 or the bobbin 20 may break. The breakage of the ring core 30 or the bobbin 20 can be avoided by a manufacturing step that injects the molten resin while clamping the ring core 30 (U core parts 30*a*, 30*b*) from its inner and outer circumferences by the bobbin protrusions 21*c*, 25*c* and the mold protrusions 51*a*, 52*a*.

The window 16*a* shown in FIG. 2 and FIG. 3 is a trace of the mold protrusion 52*a*. The windows 16*a* being traces of the mold protrusions 51*a*, 52*a* may be covered by another resin after the plastic cover 16 is completed.

The bobbin protrusions 21*c*, 25*c* and the mold protrusions 51*a*, 52*a* are arranged on a straight line ML that is parallel to axial lines CL of the pair of cylinder portions 23 extending in parallel, and is located in a midst between the two axial lines CL. According to this arrangement, the mold protrusions 51*a*, 52*a* can uniformly press the ring core 30 from its both sides along the straight line ML. Further, the bobbin protrusions 21*c*, 25*c* respectively facing the mold protrusions 51*a*, 52*a* similarly press the ring core 30 from the ring inner side toward the outer side thereof along the straight line ML in the opposite direction from that mentioned above.

This structure will also contribute to the prevention of contact of the ring core 30 and the bobbin 20 with displacement.

Some features of the art disclosed in the embodiment will be described. The flange part 25 and the flange part 21 correspond to an example of the connecting portions that connect the ends of the pair of cylinder portions 23. The bobbin protrusions 21*c*, 25*c* correspond to an example of first protrusions provided at both ends of the bobbin 20 in the cylinder axis direction. The mold protrusions 51*a*, 52*a* correspond to an example of second protrusions.

Specific examples of the present invention have been described in detail, however, these are mere exemplary indications and thus do not limit the scope of the claims. The art described in the claims includes modifications and variations of the specific examples presented above. Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

What is claimed is:

1. A method of manufacturing a reactor that comprises:

a ring core including a pair of straight portions extending in parallel;

a bobbin including a pair of cylinder portions and a pair of connecting portions, each of the pair of cylinder portions having ends and covering the corresponding straight portion, and each of the connecting portions connecting the corresponding ends;

a pair of coils, each of the coils being wound on the corresponding cylinder portion; and a plastic cover covering the ring core, the bobbin, and the pair of coils, wherein each of the connecting portions includes a first protrusion in contact with an inner circumferential surface of the ring core, and a pair of second protrusions is provided on a cavity surface of a mold in which a subassembly of the ring core, the bobbin, and the coils is to be contained and then the plastic cover is to be formed by resin injection, each of the second protrusions is provided at a position facing the corresponding first protrusion across the ring core, the method comprising:

forming the plastic cover by injecting molten resin into the mold while clamping the ring core by the first and second protrusions.

2. The method according to claim 1, wherein a top surface of each of the first protrusions and a top surface of each of the second protrusions are flat, and a contact surface of the ring core in contact with the first protrusions and a contact surface of the ring core in contact with the second protrusions are flat and disposed in parallel.

* * * * *